US008317498B2

(12) United States Patent
Gambier et al.

(10) Patent No.: US 8,317,498 B2
(45) Date of Patent: Nov. 27, 2012

(54) VALVE-SEAT INTERFACE ARCHITECTURE

(75) Inventors: Philippe Gambier, Houston, TX (US); Toshimichi Wago, Houston, TX (US); Jean-Louis Pessin, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 787 days.

(21) Appl. No.: 12/049,880

(22) Filed: Mar. 17, 2008

(65) Prior Publication Data

US 2008/0279706 A1 Nov. 13, 2008

Related U.S. Application Data

(60) Provisional application No. 60/917,366, filed on May 11, 2007, provisional application No. 60/985,874, filed on Nov. 6, 2007.

(51) Int. Cl.

| | |
|---|---|
| ***F04B 39/00*** | (2006.01) |
| ***F04B 53/00*** | (2006.01) |
| ***F16K 1/00*** | (2006.01) |
| ***F16K 15/00*** | (2006.01) |

(52) U.S. Cl. .... 417/454; 417/568; 251/334; 137/516.29

(58) Field of Classification Search ..... 417/454, 417/571, 567, 568; 137/516.27, 516.29; 251/332, 334, 356, 358; 277/500, 502, 574, 277/583, 641, 645

See application file for complete search history.

(56) References Cited

U.S. PATENT DOCUMENTS

| | | | | | |
|---|---|---|---|---|---|
| 2,107,200 | A | * | 2/1938 | Kennon | 251/332 |
| 2,259,940 | A | * | 10/1941 | Nathan | 277/626 |
| 2,260,381 | A | * | 10/1941 | Kennon | 137/516.29 |
| 2,898,082 | A | * | 8/1959 | Von Almen et al. | 251/333 |
| 3,039,488 | A | * | 6/1962 | Bowerman | 137/516.29 |
| 3,202,178 | A | | 8/1965 | Wolfe et al. | |
| 3,742,976 | A | | 7/1973 | Bailey | |
| 4,076,212 | A | | 2/1978 | Leman | |
| 4,180,097 | A | * | 12/1979 | Sjoberg | 137/516.29 |
| 4,391,328 | A | | 7/1983 | Aumann | |
| 4,784,225 | A | | 11/1988 | Petersen | |
| 4,786,209 | A | | 11/1988 | Nilsson et al. | |
| 4,951,707 | A | * | 8/1990 | Johnson | 137/516.29 |
| 5,048,604 | A | | 9/1991 | Vadasz F. et al. | |
| 5,062,480 | A | | 11/1991 | Chacin U. et al. | |
| 5,193,577 | A | * | 3/1993 | de Koning | 137/516.29 |
| 5,249,600 | A | * | 10/1993 | Blume | 137/516.29 |
| 5,297,580 | A | * | 3/1994 | Thurman | 137/533.15 |
| 7,000,632 | B2 | * | 2/2006 | McIntire et al. | 137/516.29 |
| 2004/0170507 | A1 | * | 9/2004 | Vicars | 417/360 |

FOREIGN PATENT DOCUMENTS

| | | |
|---|---|---|
| EP | 0237112 | 9/1987 |
| WO | 0030231 | 5/2000 |

* cited by examiner

*Primary Examiner* — Peter J Bertheaud

(74) *Attorney, Agent, or Firm* — Myron K. Stout; Daryl Wright; Robin Nava

(57) ABSTRACT

A pump assembly with valve-seat interface architecture configured to extend the life of pump components and the assembly. A valve of the pump assembly is equipped with a conformable valve insert that is configured with a circumferential component having the capacity to reduce the radial strain of its own deformation upon its striking of a valve seat at the interface within the pump assembly. The circumferential component may include a concave surface about the insert, a rounded abutment at the strike surface of the insert, or a core mechanism within the insert that is of greater energy absorbing character than surrounding material of the insert. Additionally, the valve seat itself may be configured for more even wear over time and equipped with a conformable seat insert to reduce wear on the valve insert.

20 Claims, 5 Drawing Sheets

VALVE-SEAT INTERFACE ARCHITECTURE

CROSS REFERENCE TO RELATED APPLICATION(S)

This Patent Document claims priority under 35 U.S.C. §119(e) to U.S. Provisional Application Ser. No. 60/917,366, entitled Valve for a Positive Displacement Pump filed on May 11, 2007 and Provisional Application Ser. No. 60/985,874, entitled Valve for a Positive Displacement Pump filed on Nov. 6, 2007, both of which are incorporated herein by reference in their entirety.

FIELD

Embodiments described relate to valve assemblies for positive displacement pumps used in high pressure applications. In particular, embodiments of a conformable valve seal or insert and configurations of a valve seat are described to make up a valve-seat interface.

BACKGROUND

Positive displacement pumps are often employed at oilfields for large high pressure applications involved in hydrocarbon recovery efforts. A positive displacement pump may include a plunger driven by a crankshaft toward and away from a chamber in order to dramatically effect a high or low pressure on the chamber. This makes it a good choice for high pressure applications. Indeed, where fluid pressure exceeding a few thousand pounds per square inch (PSI) is to be generated, a positive displacement pump is generally employed.

Positive displacement pumps may be configured of fairly large sizes and employed in a variety of large scale oilfield operations such as cementing, coil tubing, water jet cutting, or hydraulic fracturing of underground rock. Hydraulic fracturing of underground rock, for example, often takes place at pressures of 10,000 to 15,000 PSI or more to direct an abrasive containing fluid through a well to release oil and gas from rock pores for extraction. Such pressures and large scale applications are readily satisfied by positive displacement pumps.

As is often the case with large systems and industrial equipment, regular monitoring and maintenance of positive displacement pumps may be sought to help ensure uptime and increase efficiency. In the case of hydraulic fracturing applications, a pump may be employed at a well and operating for an extended period of time, say six to twelve hours per day for more than a week. Over this time, the pump may be susceptible to wearing components such as the development of internal valve leaks. This is particularly of concern at conformable valve inserts used at the interface of the valve and valve seat. Therefore, during downtime in the operation, the pump may be manually inspected externally or taken apart to examine the internal condition of the valves and inserts. In many cases the external manual inspection fails to reveal defects. Alternatively, once the time is taken to remove valves for inspection, they are often replaced wholesale regardless of operating condition, whether out of habit or for a lack of certainty. Thus, there is the risk that the pump will either fail while in use for undiagnosed leaky valves or that effectively operable valves and inserts will be needlessly discarded.

The significance of risks such as those described above may increase depending on the circumstances. In the case of hydraulic fracturing applications, such as those noted above, conditions may be present that can both increase the likelihood of pump failure and increase the overall negative impact of such a failure. For example, the conformable nature of the valve insert is that it tends to bulge and wear at the edges over time due to repeated striking of the valve seat. Additionally, the use of an abrasive containing fluid in hydraulic fracturing not only breaks up underground rock, as described above, it also tends to degrade the conformable valve inserts over time as abrasive particles are sandwiched between the inserts and the valve seat as the valve repeatedly strikes the seat. Such degradation and eventual leakage may result in failure to seal the chamber of the pump, perhaps within about one to six weeks of use depending on the particular parameters of the application. Once the chamber fails to seal during operation, the pump will generally fail in relatively short order.

Furthermore, the ramifications of such an individual pump failure may ultimately be quite extensive. That is, hydraulic fracturing applications generally employ several positive displacement pumps at any given well. Malfunctioning of even a single one of these pumps places added strain on the remaining pumps, perhaps even leading to failure of additional pumps. Unfortunately, this type of cascading pump failure, from pump to pump to pump, is not an uncommon event where hydraulic fracturing applications are concerned.

Given the ramifications of positive displacement pump failure and the demand for employing techniques that avoid pump disassembly as described above, efforts have been made to evaluate the condition of a positive displacement pump during operation without taking it apart for inspection. For example, a positive displacement pump may be evaluated during operation by employing an acoustic sensor coupled to the pump. The acoustic sensor may be used to detect high-frequency vibrations that are the result of a leak or incomplete seal within the chamber of the positive displacement pump, such a leak being the precursor to pump failure as noted above.

Unfortunately, reliance on the detection of acoustic data in order to address developing leaks at the valve-seat interface as described above fails to avoid the development of leaks in an operating pump. That is, acoustic data may do no more than provide an early indicator of potential leaks. While this may afford an operator time to take the pump off-line in order to address the potential leak, there remains no effective manner in which to avoid the leak in the first place without the need of taking the pump off-line. Thus, at a minimum, even where a catastrophic leak is avoided due to early acoustic detection, down time for the pump at issue still results. There remains no substantially effective manner in which to avoid leaks at the valve-seat interface in an operating positive displacement pump for which abrasives are pumped and a conformable valve insert is employed.

SUMMARY

A pump assembly is provided. The pump assembly has a valve-seat interface with a valve having a conformable valve insert about the valve and a valve seat defining a fluid path through the assembly. The conformable valve insert is configured for striking the valve seat for closing the fluid path and includes a circumferential component to accommodate deformation thereof upon the striking of the conformable valve insert upon the valve seat.

DETAILED DESCRIPTION

Embodiments are described with reference to certain high pressure positive displacement pump assemblies for fracturing operations. However, other positive displacement pumps may be employed. Regardless, embodiments described herein employ a valve-seat interface wherein a valve or a valve seat are configured with a component for accommodating the deformation of the valve or seat upon a striking of the valve upon the valve seat.

Figure 1:
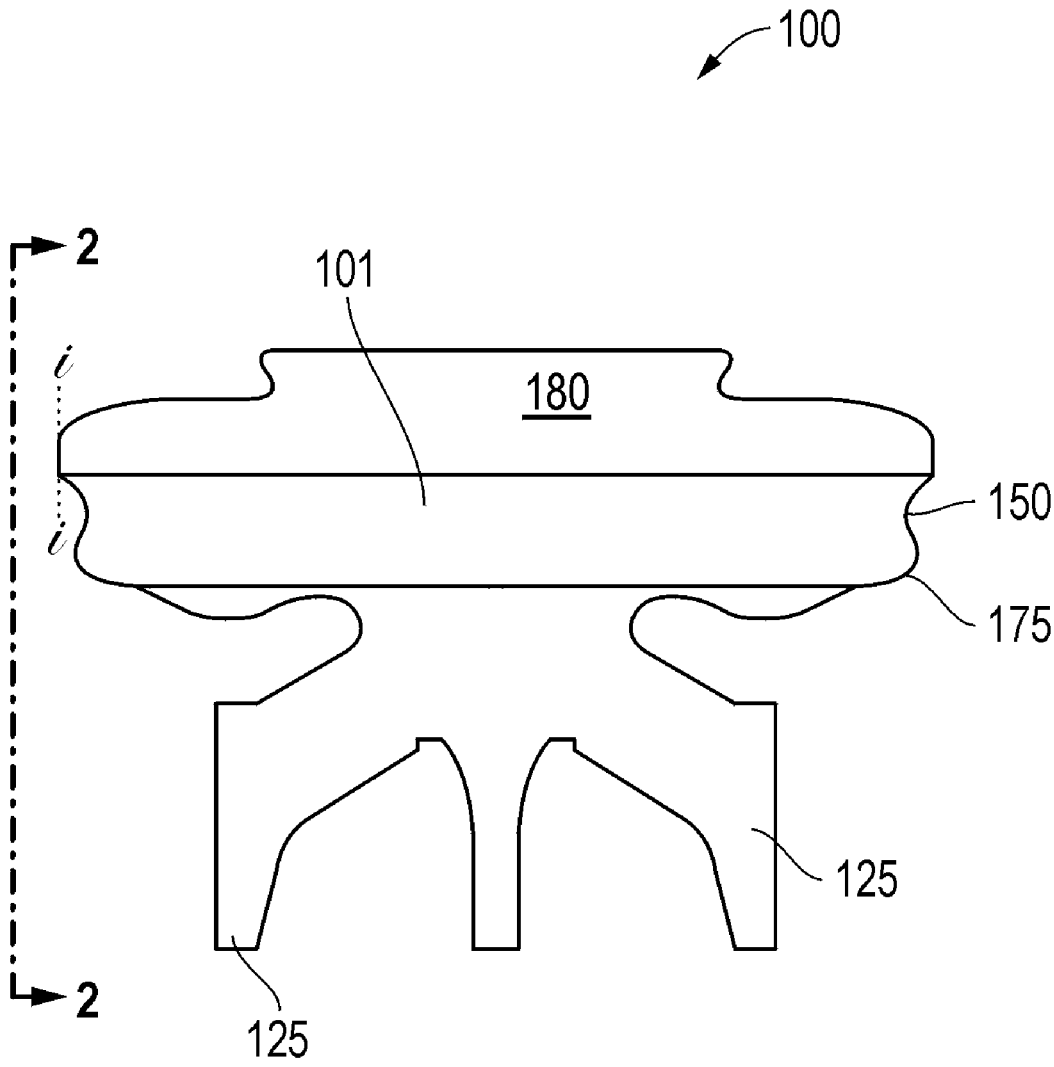
FIG. 1 is a side view of an embodiment of a valve for a pump assembly.
Figure 3:
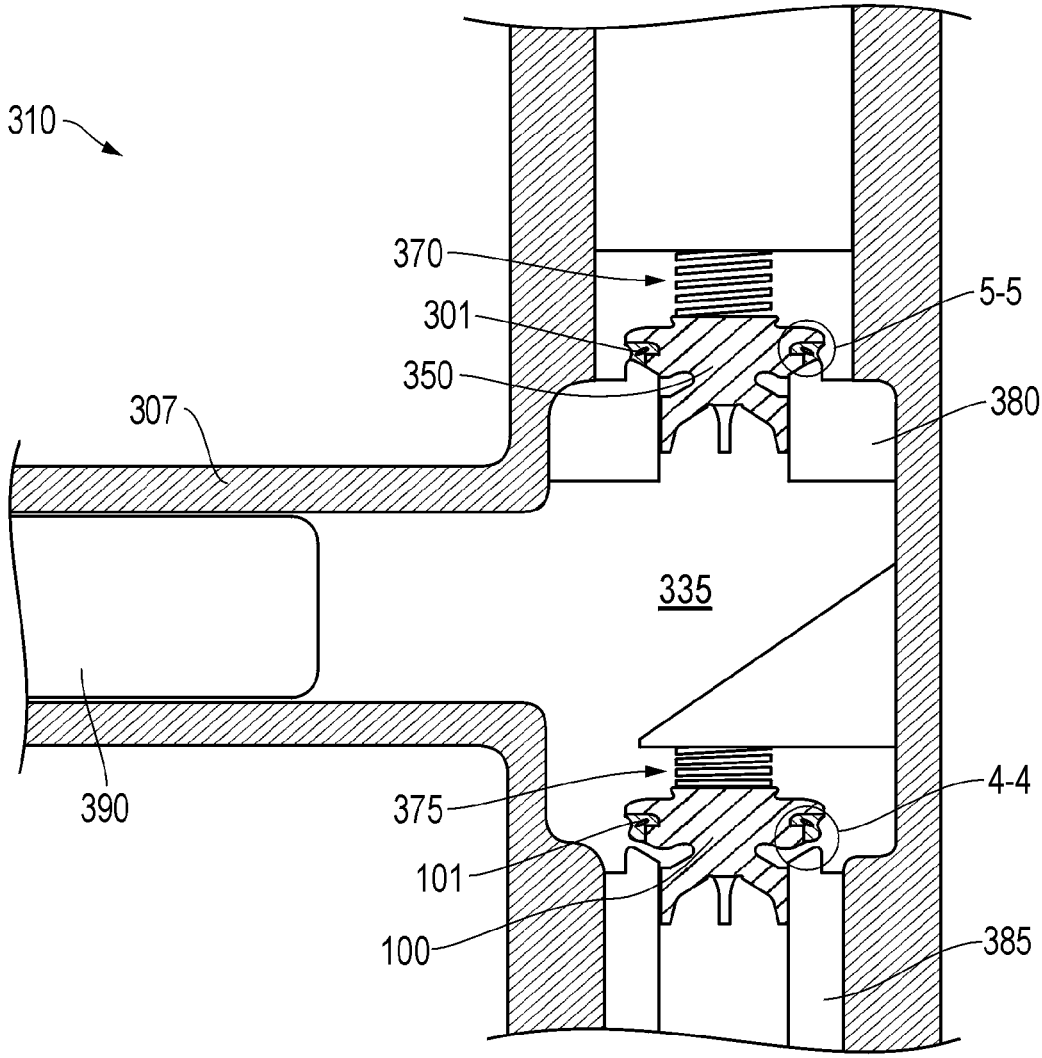
FIG. 3 is a side cross-sectional view of an embodiment of a pump assembly employing the valve of FIG. 1.

Referring to FIG. 1, an embodiment of a valve 100 is depicted for use in a pump assembly 310 as depicted in FIG. 3. As such, the valve 100 is of a standard positive displacement valve configuration with a head 180 coupled to aligning legs 125 therebelow. However, the valve 100 of FIG. 1 also includes an embodiment of a conformable valve insert 101 disposed about the head 180. The conformable valve insert 101 may be made of urethane or other conventional polymers. However, as described below, the conformable valve insert 101 is configured to accommodate deformation of the valve insert 101 upon the striking of the valve 100 and insert 101 at a valve seat 385 as depicted in FIG. 3. In this manner, the life of the conformable valve insert 101 may be extended in the face of pumped abrasive fluids and repeated striking of the valve 100 and insert 101 at the valve seat 385. Thus, the life of the valve 100 and pump assembly 310, as well as neighboring assemblies 600, may similarly be extended as detailed hereinbelow (see FIGS. 3 and 6).

Figure 2:
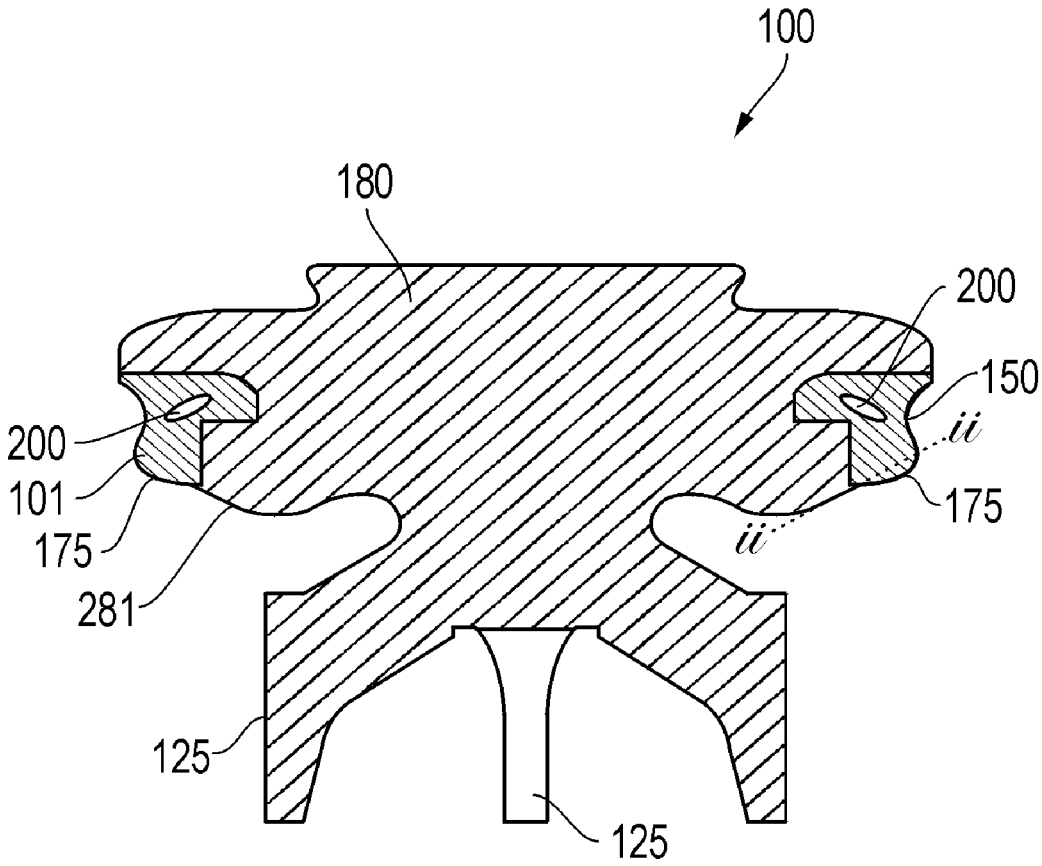
FIG. 2 is a side cross-sectional view of the valve of FIG. 1 taken from section 2-2.

As indicated, the conformable valve insert 101 depicted in FIG. 1 is configured to accommodate its own deformation upon striking of a valve seat 385 as shown in FIG. 3. In particular, the insert 101 is configured with at least one circumferential component to reduce stress concentration and accommodate its own deformation. As shown in FIG. 1, these components may include a concave surface 150 and a rounded abutment 175. With reference to vertical line i-i, the concave surface 150 in particular may be further defined. For example, with added reference to FIG. 2, the conformable valve insert 101 is configured for fitting within a recess of the valve head 180. As depicted in FIGS. 1 and 2, the outermost edge of this recess is found at vertical line i-i, which also happens to correspond with the outermost edge of the valve head 180. However, this is not required. Regardless, it is apparent that the insert 101 fails to extend outward as far as vertical line i-i at the location of the concave surface 150. That is, at the location of the concave surface 150 the insert 101 is of a profile that is less than that of the valve head 180 (e.g. at vertical line i-i).

The reduced profile of the conformable valve insert 101 provided by the concave surface 150 is present about the entire circumference of the insert 101 providing the appearance of a groove at its surface. As such, when the valve insert 101 strikes against the valve seat 385 as shown in FIG. 3, deformation of the insert 101 fails to result in undue outward bulging of the insert beyond the valve head 180 (i.e. vertical line i-i) to any significant degree. Such bulging may be damaging to the insert 101. However, the presence of a circumferential component such as the concave surface 150 may help to minimize such bulging, thereby extending the life of the insert 101. Stated another way, the concave surface 150 reduces the concentrated radial strain of deformation felt through the insert 101 upon striking of the valve 100.

Continuing with reference to FIG. 2, with added reference to FIG. 3, the concave surface 150 as described above is shown. Additionally, the above noted rounded abutment 175 may be detailed with reference to diagonal line ii-ii. Again, the rounded abutment 175 is a circumferential component about the conformable valve insert 101. In this case, the rounded abutment 175 is the portion of the insert 101 which is configured for directly striking the valve seat 385. In fact, the rounded abutment 175 extends below the diagonal line ii-ii such that it is the first component of the valve 100 to strike the valve seat 385. That is, as depicted in FIG. 2, the diagonal line ii-ii is aligned with the strike face 281 of the valve head 180 which is thrust against the valve seat 385 during operation of a pump assembly 310 as depicted in FIG. 3. Thus, by extending below the diagonal line ii-ii, the rounded abutment 175 actually makes contact with the valve seat 385 in advance of the strike face 281 of the valve head 180.

In addition to contacting the valve seat 385 of FIG. 3 in advance of the strike face 281, the rounded abutment 175 indeed provides a rounded convex shape to the striking surface of the conformable valve insert 101. Thus, the valve insert 101 transitions into contact with the valve seat 385 in a tapered manner as opposed to making instantaneous contact across the entire lower surface of the insert 101. As such, the impact on the conformable valve insert 101 is spread out over a greater period, thereby reducing strain on the insert 101. Additionally, the use of a rounded abutment 175 with a small surface area making initial contact with the valve seat 385 reduces the likelihood that a significant amount of proppant or abrasive particles will be squeezed between the insert 101 and the seat 385 at the initial moment of strike when stress is at its greatest. Thus, the deteriorating effects of proppant on the conformable valve insert 101 may be minimized.

In fact, the benefits of this manner of striking between the valve seat 385 and the valve 100 may also be imparted to the strike face 281 and the valve seat 385 to a degree. That is, due to the extension of the rounded abutment 175 to below the diagonal line ii-ii as described above, the impact of a given strike is initially felt at the insert 101, thereby reducing the degree of impact between the strike face 281 and the valve seat 385 during the strike. Thus, the circumferential component of a rounded abutment 175 provides stress reduction to the valve-seat interface in terms of the valve insert 101, the valve 100, and the valve seat 385.

Continuing with reference to FIG. 2, with added reference to FIG. 3, another circumferential component of the valve insert 101 for reducing strain in the face of impact with a valve seat 385 is depicted. Namely, a core mechanism 200 is disposed within the insert 101. The core mechanism 200 may be energy absorbing in nature and of a mechanical character differing from that of the material of the surrounding or adjacent body of the insert 101. For example, in one embodiment, the core mechanism 200 is an air filled coil configured to absorb a portion of the energy of a strike of the valve 100 upon a valve seat 385. The body of the insert may be of a less energy absorbing material such as the noted urethane. Thus, the more robust energy absorbing component of a core mechanism 200 may be employed to extend the life of the conformable valve insert 101.

Referring now to FIG. 3, an embodiment of a positive displacement pump assembly 310 employing a valve 100 with a conformable valve insert 101 as described above is illustrated. The pump assembly 310 includes a plunger 390 for reciprocating within a plunger housing 307 toward and away from a chamber 335. In this manner, the plunger 390 effects high and low pressures on the chamber 335. For example, as the plunger 390 is thrust toward the chamber 335, the pressure within the chamber 335 is increased. At some point, the pressure increase will be enough to effect an opening of the discharge valve 350 to allow release of fluid and pressure from within the chamber 335. The amount of pressure required to open the discharge valve 350 as described may be determined by a discharge mechanism 370 such as a spring which keeps the discharge valve 350 in a closed position (as shown) until the requisite pressure is achieved in the chamber 335. In an embodiment where the pump assembly 310 is employed in a fracturing operation, for example, pressures may be achieved in the manner described that exceed 2,000 PSI, and more preferably, that exceed 10,000 PSI or more.

The above described plunger 390 also effects a low pressure on the chamber 335. That is, as the plunger 390 retreats away from an advanced position near the chamber 335, the pressure therein will decrease. As the pressure decreases, the discharge valve 350 will strike closed against the discharge valve seat 380 as depicted in FIG. 3. This movement of the plunger 390 away from the chamber 335 will initially result in a sealing off of the chamber 335. However, as the plunger 390 continues to move away from the chamber 335, the pressure therein will continue to drop, and eventually a low or negative pressure will be achieved within the chamber 335. Eventually, as depicted in FIG. 3, the pressure decrease will be enough to effect an opening of the valve 100 (acting here as an intake valve). The opening of the valve 100 in this manner allows the uptake of fluid into the chamber 335. The amount of pressure required to open the valve 100 as described may be determined by an intake mechanism 375 such as a spring which keeps the intake valve 100 in a closed position until the requisite low pressure is achieved in the chamber 335.

As described above, a reciprocating or cycling motion of the plunger 390 toward and away from the chamber 335 within the pump assembly 310 controls pressure therein. The valves 350 and 100 respond accordingly in order to dispense fluid from the chamber 335 at high pressure and draw additional fluid into the chamber 335. As part of this cycling of the pump assembly 310 repeated striking of the discharge valve 350 against a discharge valve seat 380 and of the intake valve 100 against the intake valve seat 385 occurs. However, due to the configurations of conformable valve inserts 101, 301 and other features of each valve-seat interface, as detailed above and further below, the useful life of the inserts 101, 301 may be substantially extended. This may be of cascading beneficial effect to the life of the valves 100, 350, the pump assembly 310 itself, and even neighboring assemblies 600 as described further below (see FIG. 6).

Figure 4:
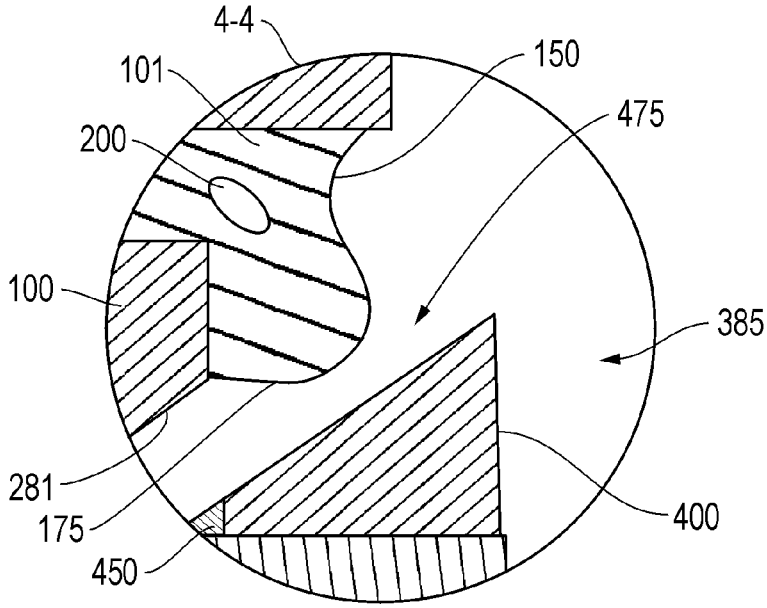
FIG. 4 is an enlarged view of a valve-seat interface taken from 4-4 of FIG. 3.
Figure 5:
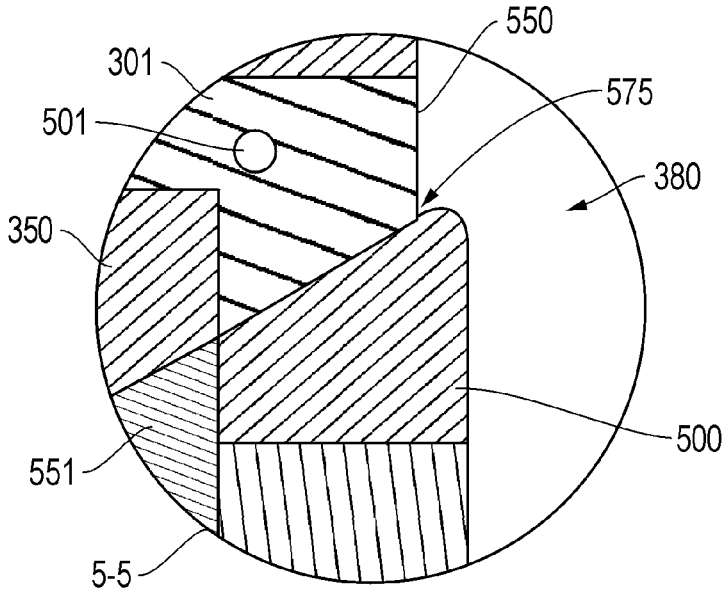
FIG. 5 is an enlarged view of a valve-seat interface taken from 5-5 of FIG. 3.

Continuing with reference to FIGS. 4 and 5, with added reference to FIG. 3, a comparison is drawn between the valve-seat interfaces 475, 575 before and during the strike of a valve 100, 350 at a valve seat 385, 380. In the embodiment shown, each valve 100, 350 is equipped with a substantially equivalent conformable valve insert 101, 301. Thus, of particular note is the comparison of the changing morphology of the inserts 101, 301 when moving from a position away from a given valve seat 385 as depicted in FIG. 4 to striking a valve seat 380 as depicted in FIG. 5.

With reference to FIG. 4, an enlarged view of the structural architecture at the valve-seat interface 475 employing the discharge valve 100 of FIGS. 1-3 is depicted. As detailed above, the valve 100 is equipped with a conformable valve insert 101 having variety of circumferential components configured to help accommodate its own deformation upon striking of the valve seat 385. That is, as described above, a concave surface 150, a rounded abutment 175, and a core mechanism 200 are all incorporated into the insert 101 to help reduce concentrated radial strain of deformation felt through the insert 101 upon the striking of the valve 100 against the valve seat 385. When examining the equivalent circumferential components at the valve-seat interface 575 of FIG. 5, with a valve 350 striking a valve seat 380, the behavior of such a valve insert 301 is apparent.

With reference to FIG. 5, an enlarged view of the intake valve 350 of FIG. 3 is depicted. Unlike the interface 475 of FIG. 4, the valve-seat interface 575 of FIG. 5 reveals a valve 350 as it strikes a valve seat 380. Deforming of the conformable valve insert 301 of the striking valve 350 against the valve seat 380 is apparent. However, much of the strain of the deformation on the insert is absorbed by the core mechanism 501 and its energy absorbing nature. Additionally, the strain of the deformation is absorbed over a period due to the use of a rounded abutment such as that of FIG. 4 and detailed above (e.g. 175), now flattened out across the surface of the valve seat 380. Furthermore, a concave surface of the insert 301 such as that of FIGS. 1-4 as detailed above (e.g. 150) has given way to a more flattened surface 550. That is, as the conformable valve insert 301 is struck against the valve seat 380, the stress of deformation is radiated outward. However, due to the initial concave nature of the outer radial surface of the insert 301, a more flattened surface 550 is imparted as opposed to potentially damaging bulging of the insert 301 as detailed above.

Continuing again with reference to FIGS. 4 and 5, additional components may be provided for reducing concentrated stress at the interface 475, 575 upon the impact of a valve 100, 350 striking a valve seat 385, 380. While such components are detailed above with respect to the conformable valve inserts 101, 301, valve seats 385, 380 may be configured to accommodate and reduce stress concentration. For example, conformable seat inserts 400, 500 may be employed as depicted in FIGS. 4 and 5. These seat inserts 400, 500 may be configured to distribute the stress of valve strikes similar to the valve inserts 101, 301 described above.

However, of potentially greater significance, is the fact that a seat insert 400, 500 of conformable material aligning with a valve insert 101, 301 of conformable material may help to avoid the imparting of abrasive forces of proppant or particulate into the valve insert 101, 301 during a valve strike. For example, with reference to FIG. 5, by allowing for the aligning surface of the valve seat 380 to be of a conformable material, any proppant or particulate trapped at the interface 575 during a valve strike may be roughly equivalently absorbed into the surfaces of each feature (e.g. 301, 500) as opposed to having a hard surface of the valve seat 380 imparting stray particulate into the conformable surface of the valve insert 301. As a result, abrasive wear on the insert 301 may be substantially reduced. Thus, once again, the life of the insert 301 may be substantially extended. In one embodiment, the valve insert 301 and the seat insert 500 are both of a polymer material such as urethane.

Continuing with additional reference to FIGS. 4 and 5, additional measures may be taken relative to the valve seats 385, 380. Namely, the valve seat 385, 380 may include a robust region 450, 551 for alignment with a portion of the valve 100, 350 devoid of any conformable valve insert 101, 301 (e.g. the strike face 281 of the valve 100 as shown in FIG. 2). Thus, as the seat 385, 380 is repeatedly struck by the valve 100, 350 and particulate repeatedly sandwiched at the interface over time, wear and abrasion may nevertheless be held to a minimum, extending the life of the seat 385, 380 itself.

Indeed the robust region 450, 551 may even be configured to wear at a rate that does not substantially exceed the rate of wear in an adjacent region making contact with the valve insert 101, 301. That is, the valve insert 101, 301 may be of a conformable material as noted, imparting only limited stress and wear on such an adjacent region of the valve seat 380, 385. In the embodiment shown, such an adjacent region would be at the seat insert 400, 500. However, even in circumstances where no conformable seat insert 400, 500 is employed, a robust region 450, 551 of greater robustness than its adjacent region may be employed so as to avoid significant differences in the rate of wear between the robust region 450, 551 and its adjacent region. In one embodiment, the robust region 450, 551 may be of tungsten carbide or a ceramic material of greater abrasion resistance than its adjacent region. Similarly, the adjacent region may be of a hardened steel or a polymer such as urethane, as in the case of the seat insert 400, 500 detailed above.

Figure 6:
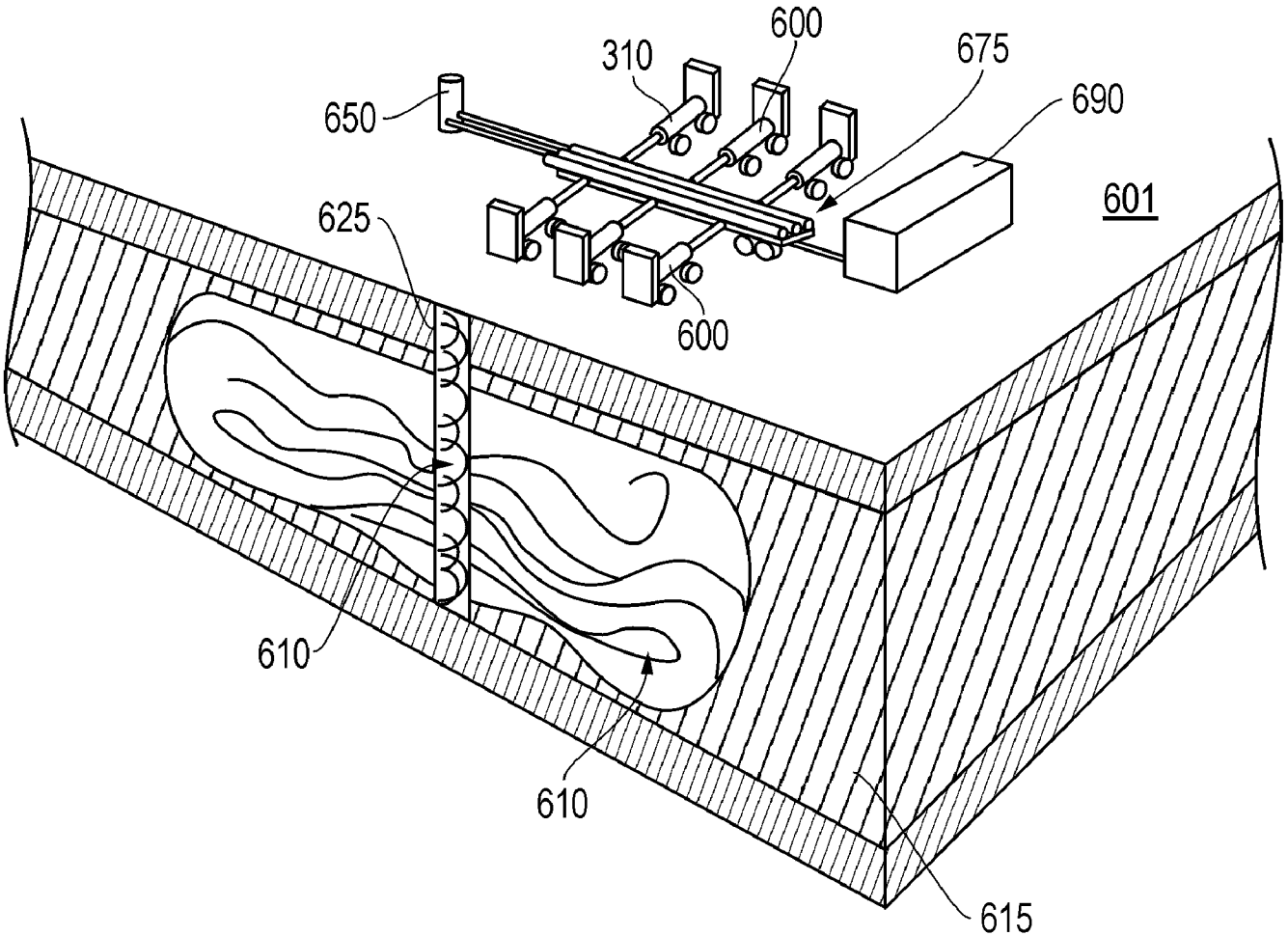
FIG. 6 is an overview of an oilfield employing surface equipment including the pump assembly of FIG. 3.

Continuing now with reference to FIG. 6, multiple positive displacement pump assemblies 600 are shown employed in conjunction with the above described assembly 310. The assemblies 310, 600 are a part of a hydraulic fracturing system at an oilfield 601. The pump assemblies 310, 600 may operate at between about 700 and about 2,000 hydraulic horsepower to propel an abrasive fluid 610 into a well 625. The abrasive fluid 610 contains a proppant such as sand, ceramic material or bauxite for disbursing beyond the well 625 and into fracturable rock 615 for the promotion of hydrocarbon recovery therefrom.

In addition to the six pump assemblies 310, 600 shown, other equipment may be directly or indirectly coupled to the well head 650 for the operation. This may include a manifold 675 for fluid communication between the assemblies 310, 600. A blender 690 and other equipment may also be present. In total, for such a hydraulic fracturing operation, each assembly 310, 600 may generate between about 2,000 and about 15,000 PSI or more. Thus, as valves 100, 350 strike seats 385, 380 within each assembly 310, 600, an extreme amount of stress is concentrated at each valve-seat interface 475, 575 (see FIGS. 1-5). Nevertheless, with added reference to FIGS. 1-5, the rate of deterioration of valve-seat architecture for each assembly 310, 600 may be dramatically reduced through use of features detailed hereinabove. Thus, the useful life of valves 100, 350, seats 385, 380 and their respective assemblies 310 may be extended. As such, compromise or added strain on adjacent assemblies 600 may be avoided for a fracturing operation as depicted in FIG. 6.

The above embodiments of valve-seat architecture may be employed to extend the life of valves and related equipment for positive displacement pump assemblies that are configured for pumping abrasive fluids. Thus, the need to disassemble pump equipment in order to monitor the condition of pump internals may be reduced. Indeed, extending the life of such abrasive fluid pumping equipment may include the delay or substantial prevention of the occurrence of valve leaks as opposed to simply acoustically monitoring leak occurrences.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, circumferential components are depicted herein as uniformly disposed about a valve insert. However, alternate embodiments of a concave surface, rounded abutment, core mechanism or other circumferential component may be employed that are of a discontinuous, asymmetrical, or other non-uniform configuration throughout the valve insert. Furthermore, the foregoing description should not be read as pertaining only to the precise structures described and shown in the accompanying drawings, but rather should be read as consistent with and as support for the following claims, which are to have their fullest and fairest scope.

We claim:

1. A pump assembly comprising:

a valve seat;

a valve for striking said valve seat, the valve comprising a valve head; and a conformable valve insert about said valve head for contacting said valve seat during the striking, said conformable valve insert having a circumferential component to reduce radial strain of deformation of said conformable valve insert upon the striking, the circumferential component partially defining an outermost profile of said valve; wherein the circumferential component comprises a curved concave surface reducing said outermost profile of said valve and a rounded abutment to initiate contact with said valve seat in a tapered manner upon the striking, said rounded abutment extending radially beyond said curved concave surface;

wherein said conformable valve insert does not extend outwardly beyond an outermost radial edge of the valve head.

2. The pump assembly of claim 1 wherein said valve head comprises a recess for accommodating said conformable valve insert and an exposed strike face adjacent said conformable valve insert for directly meeting said valve seat during the striking.

3. The pump assembly of claim 2 wherein the curved concave surface reduces an outermost profile of said conformable valve insert to less than a profile of the outermost radial edge of the valve head.

4. The pump assembly of claim 1 wherein said circumferential component further comprises a core mechanism disposed within said conformable valve insert, said core mechanism being of a greater energy absorbing character than an adjacent body of said conformable valve insert.

5. The pump assembly of claim 4 wherein the core mechanism is an air filled coil.

6. The pump assembly of claim 1 wherein said pump assembly pumps fluid through a hydraulic fracturing system at an oilfield.

7. The pump assembly of claim 6 wherein the pump assembly is a first pump assembly and the hydraulic fracturing system further comprises at least one neighboring pump assembly coupled to the first pump assembly.

8. The pump assembly of claim 6 wherein the fluid includes an abrasive proppant therein.

9. A pump assembly comprising:

a conformable valve insert;

a valve having a valve head comprising an exposed strike face and a circumferential recess, said circumferential recess accommodating said conformable valve insert; said conformable valve insert having a circumferential component, the circumferential component partially defining an outermost profile of said valve; and a valve seat to accommodate striking of said conformable valve insert and the exposed strike face, said valve seat having a robust region aligned with the exposed strike face and an adjacent region aligned with said conformable valve insert, the robust region of abrasion resistance exceeding that of the adjacent region;

wherein the circumferential component comprises a curved concave surface reducing said outermost profile of said valve and a rounded abutment to initiate the striking of the conformable valve insert at the valve seat in a tapered manner in advance of the striking of the valve seat by the exposed strike face, said rounded abutment extending radially beyond said curved concave surface; and wherein said conformable valve insert does not extend outwardly beyond an outermost radial edge of the valve head.

10. The pump assembly of claim 9 wherein the robust region is of a material selected from a group consisting of tungsten carbide and a ceramic.

11. The pump assembly of claim 9 wherein the adjacent region is of a material selected from a group consisting of hardened steel and urethane.

12. The pump assembly of claim 9 wherein said circumferential component reduces radial strain of deformation of said conformable valve insert upon the striking.

13. The pump assembly of claim 12 wherein said curved concave surface reduces an outermost profile of said conformable valve insert to less than a profile of the outermost radial edge of the valve head; and wherein the circumferential component further comprises a core mechanism disposed within said conformable valve insert, said core mechanism being of a greater energy absorbing character than an adjacent body of said conformable valve insert.

14. A pump assembly for pumping an abrasive fluid and comprising:

a valve seat;

a conformable seat insert disposed at a surface of said valve seat; and a valve having a valve head and a conformable valve insert exposed at a surface thereof for striking upon said conformable seat insert; said conformable valve insert having a circumferential component, the circumferential component partially defining an outermost profile of said valve;

wherein the circumferential component comprises a curved concave surface reducing said outermost profile of said valve and a rounded abutment to initiate the striking of the conformable seat insert in a tapered manner in advance of a striking of the valve seat by the valve head, said rounded abutment extending radially beyond said curved concave surface; and wherein said conformable valve insert does not extend outwardly beyond an outermost radial edge of the valve head.

15. The pump assembly of claim 14 wherein said conformable seat insert and said conformable valve insert are of a polymeric material.

16. The pump assembly of claim 14 wherein said circumferential component reduces radial strain of deformation of said conformable valve insert upon the striking.

17. A valve for a positive displacement pump, the valve comprising:

a head having a circumferential recess and configured for striking a valve seat within the positive displacement pump; and a conformable valve insert disposed within the circumferential recess for contacting the valve seat during the striking and having a circumferential component to reduce a radial strain of deformation of said conformable valve insert upon the striking, the circumferential component partially defining an outermost profile of said valve; wherein the circumferential component comprises a curved concave surface reducing said outermost profile of said valve and a rounded abutment to initiate contact with said valve seat in a tapered manner upon the striking, said rounded abutment extending radially beyond said curved concave surface;

wherein said conformable valve insert does not extend outwardly beyond an outermost radial edge of the head.

18. The valve of claim 17 wherein said head further comprises an exposed strike face adjacent said conformable valve insert for directly meeting the valve seat during the striking, the curved concave surface reducing an outermost profile of said conformable valve insert to less than a profile of the outermost radial edge of the head; and wherein the circumferential component further comprises a core mechanism disposed within said conformable valve insert, said core mechanism being of a greater energy absorbing character than an adjacent body of said conformable valve insert.

19. A conformable valve insert of a valve for sealing against a valve seat of a positive displacement pump, the conformable valve insert comprising a circumferential component to reduce a radial strain of deformation of said conformable valve insert upon the sealing, the circumferential component partially defining an outermost profile of said valve; wherein the circumferential component comprises a curved concave surface reducing said outermost profile of said valve and a rounded abutment to initiate the sealing of the conformable valve insert at the valve seat in a tapered manner in advance of a striking of the valve seat by a valve head to which the conformable valve insert is attached, said rounded abutment extending radially beyond said curved concave surface; wherein said conformable valve insert does not extend outwardly beyond an outermost radial edge of the valve head.

20. The conformable valve insert of claim 19 wherein the valve head has a recess to accommodate the conformable valve insert and is configured for striking the valve seat with an exposed strike face adjacent said conformable valve insert, the curved concave surface reducing an outermost profile of said conformable valve insert to less than a profile of the outermost radial edge of the valve head; wherein the circumferential component further comprises a core mechanism disposed within said conformable valve insert, said core mechanism being of a greater energy absorbing character than an adjacent body of said conformable valve insert.

* * * * *